US010998652B2

(12) United States Patent
Mitsui et al.

(10) Patent No.: US 10,998,652 B2
(45) Date of Patent: May 4, 2021

(54) SHIELD TERMINAL

(71) Applicant: Sumitomo Wiring Systems, Ltd., Yokkaichi (JP)

(72) Inventors: Shohei Mitsui, Yokkaichi (JP); Liping Kang, Yokkaichi (JP); Norihito Hashimoto, Yokkaichi (JP); Motoki Kubota, Yokkaichi (JP); Ai Hirano, Yokkaichi (JP); Masanobu Kasuga, Yokkaichi (JP); Keisuke Kanemura, Yokkaichi (JP); Wataru Yamanaka, Yokkaichi (JP); Ryo Yamada, Toyota (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/802,766

(22) Filed: Feb. 27, 2020

(65) Prior Publication Data

US 2020/0274262 A1 Aug. 27, 2020

(30) Foreign Application Priority Data

Feb. 27, 2019 (JP) ..... JP2019-033599

(51) Int. Cl.
*H01R 24/38* (2011.01)
*H01R 9/05* (2006.01)
*H01R 13/66* (2006.01)

(52) U.S. Cl.
CPC ..... *H01R 9/05* (2013.01); *H01R 13/6625* (2013.01); *H01R 24/38* (2013.01)

(58) Field of Classification Search
None
See application file for complete search history.

(56) References Cited

U.S. PATENT DOCUMENTS 3,302,159 A * 1/1967 Schumacher ..... H01R 9/0518 439/620.21
4,647,138 A * 3/1987 Muz ..... H01R 9/05 439/578
7,223,916 B2 * 5/2007 Kawamura ..... H01R 9/0518 174/84 C
7,670,182 B2 * 3/2010 Morikawa ..... H01R 9/0518 439/620.03
8,079,870 B2 * 12/2011 Nakamura ..... H01R 9/0518 439/585
2019/0386439 A1 * 12/2019 Kameyama ..... H01R 24/42

FOREIGN PATENT DOCUMENTS

JP 2006-107801 4/2006

* cited by examiner

*Primary Examiner* — Felix O Figueroa
(74) *Attorney, Agent, or Firm* — Gerald E. Hespos; Michael J. Porco; Matthew T. Hespos

(57) ABSTRACT

A shield terminal (10) includes an inner conductor terminal (11), an outer conductor terminal (13), a dielectric (12) and a capacitor serving as an electronic element (16). The outer conductor terminal (13) surrounds the inner conductor terminal (11) and is connected to a shield portion (93) of a shielded cable (90). The dielectric (12) is arranged between the inner conductor terminal (11) and the outer conductor terminal (13). The electronic element (16) includes a core connecting portion (43) to be connected to a core (91) of the shielded cable (90) and an inner conductor connecting portion (42) to be connected to the inner conductor terminal (11). In the shield terminal (10), an insulating short circuit preventing member (14) is arranged between the core connecting portion (43) and the outer conductor terminal (13).

5 Claims, 11 Drawing Sheets

SHIELD TERMINAL

BACKGROUND

Field of the Invention

The invention relates to a shield terminal.

Related Art

A shield terminal with a built-in capacitor serving as an electronic element is used on an end part of a shielded cable (coaxial cable) in a harness, such as a radio antenna harness installed in an automotive vehicle. For example, a shield terminal of Japanese Unexamined Patent Publication No. 2006-107801 includes an electronic element having two lead wires, an inner conductor terminal connected to one of the lead wires, a dielectric for accommodating the inner conductor terminal and an outer conductor terminal accommodating the dielectric and connected to a shield conductor of a shielded cable. The other lead wire of the electronic element is connected to a core of the shielded cable. An element accommodation chamber for accommodating the electronic element penetrates through the dielectric.

In the above case, a body of the electronic element is accommodated into the element accommodation chamber of the dielectric, but nothing is present between the other lead wire and the outer conductor terminal and the other lead wire may short to the outer conductor terminal while being connected to the core of the shielded cable.

This invention was completed on the basis of the above situation and aims to provide a shield terminal capable of preventing a part of an electronic element connected to a shielded cable from shorting to an outer conductor terminal.

SUMMARY

The invention is directed to a shield terminal with an inner conductor terminal and an outer conductor terminal surrounding the inner conductor terminal. The outer conductor terminal is connected to a shield of a shielded cable. A dielectric is arranged between the inner conductor terminal and the outer conductor terminal. An electronic element includes a core connecting portion to be connected to a core of the shielded cable and an inner conductor connecting portion to be connected to the inner conductor terminal. An insulating short circuit preventing member is arranged between the core connecting portion and the outer conductor terminal.

The insulating short circuit preventing member is between the core connecting portion of the electronic element and the outer conductor terminal. Thus, the core connecting portion connected to the core of the shielded cable cannot short to the outer conductor terminal.

The short circuit preventing member may be separate from the dielectric and arranged away from the dielectric. According to this configuration, the dielectric need not extend to a position corresponding to the core connecting portion and enlargement of the dielectric can be avoided. Further, the presence of the dielectric in the outer conductor terminal does not become an obstacle and a degree of freedom in design and process can be enhanced.

The outer conductor terminal may be provided with a tool insertion hole open between the short circuit preventing member and the dielectric, and the inner conductor connecting portion may be arranged to face the tool insertion hole. According to this configuration, after the inner conductor terminal and the dielectric are incorporated into the outer conductor terminal, the electronic element can be located in the outer conductor terminal and the inner conductor connecting portion and the inner conductor terminal can be connected through the tool insertion hole. The tool insertion hole is in the outer conductor terminal in this way by forming the short circuit preventing member separately from the dielectric and arranging the short circuit preventing member away from the dielectric.

The short circuit preventing member may include a support to be locked to the outer conductor terminal, and the electronic element may be placed and supported on the support. According to this configuration, the short circuit preventing member has a function of supporting the electronic element in addition to a function of preventing a short circuit of the core connecting portion and the outer conductor terminal. Thus, the configuration of the shield terminal can be simplified as compared to the case where the short circuit preventing function and the supporting function are provided separately in the shield terminal.

DETAILED DESCRIPTION

Figure 1:
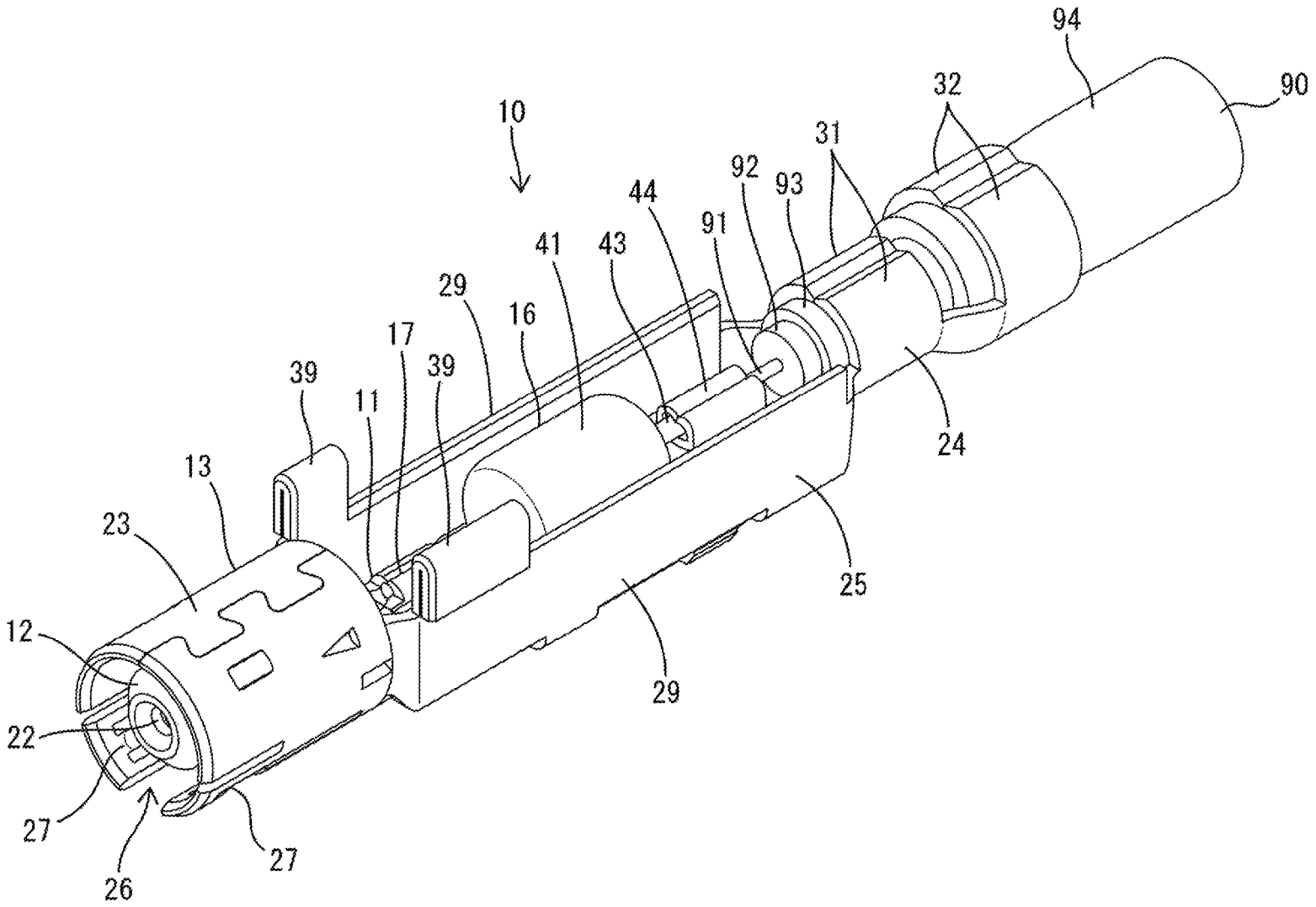
FIG. 1 is a perspective view of a shield terminal of one embodiment of the present invention viewed obliquely from above.
Figure 2:
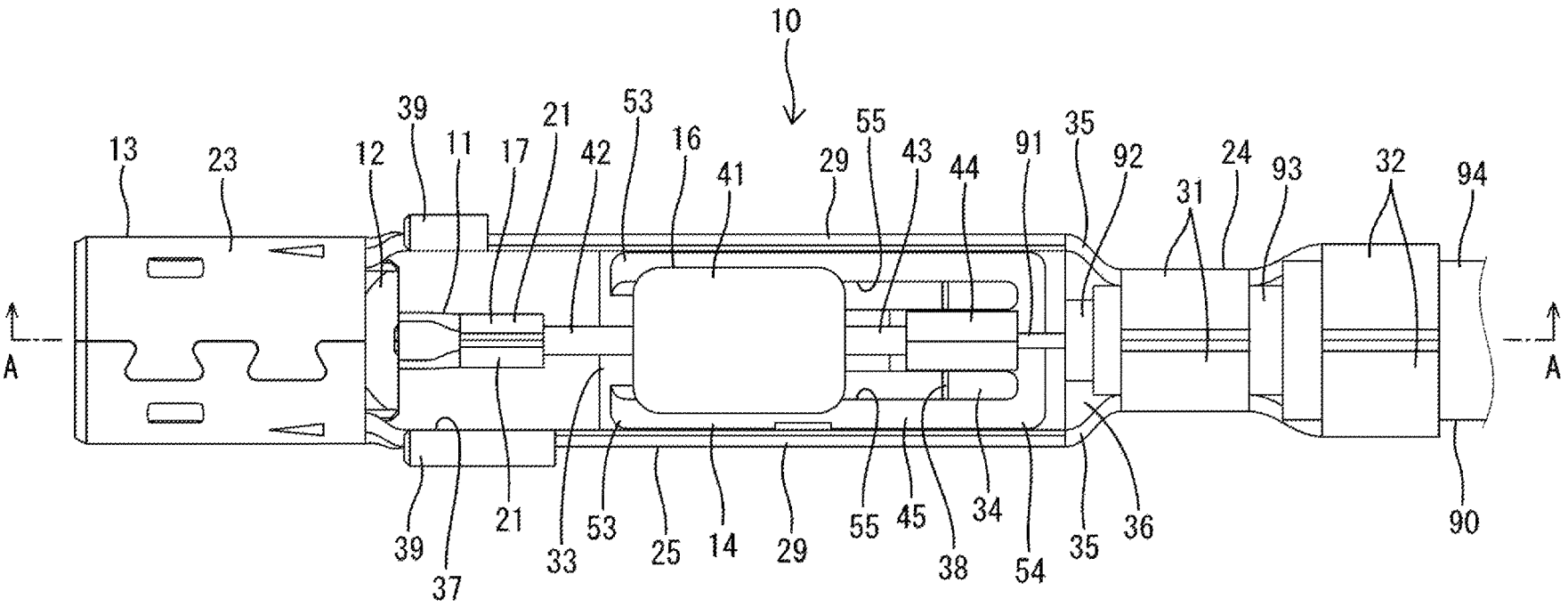
FIG. 2 is a plan view of the shield terminal.
Figure 3:
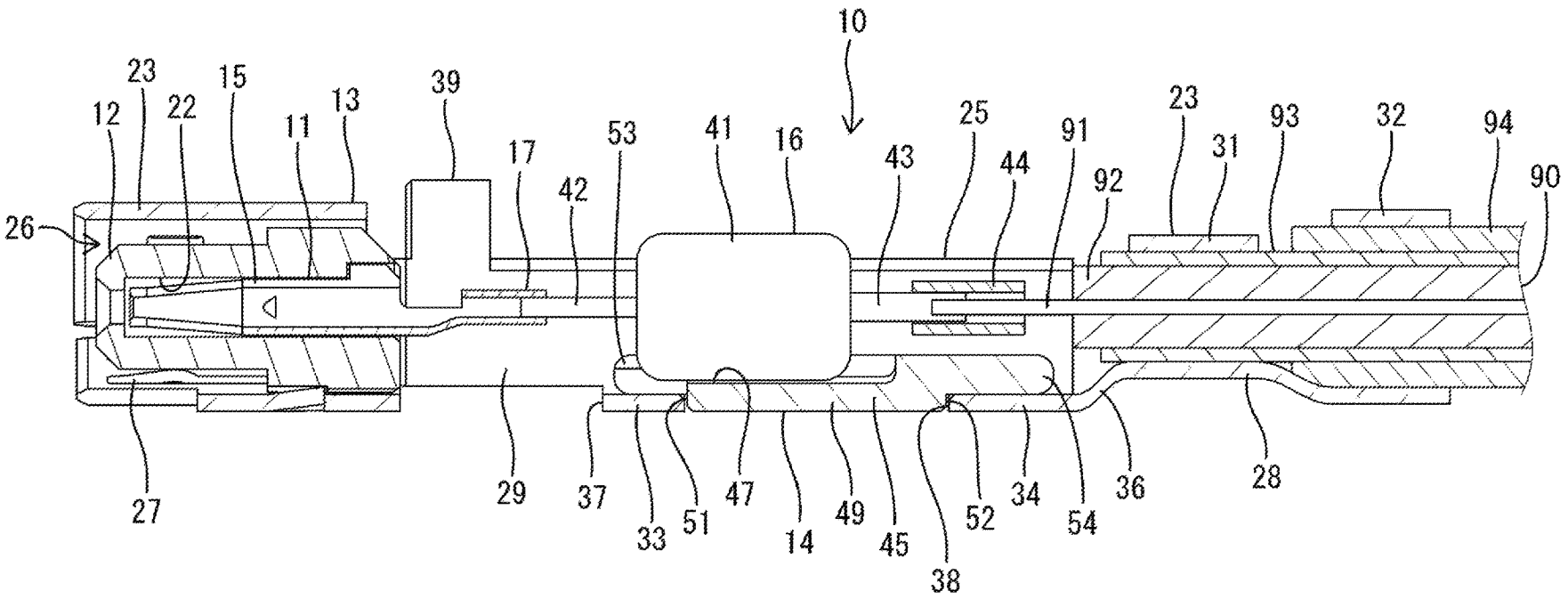
FIG. 3 is a section along A-A of FIG. 2.
Figure 7:
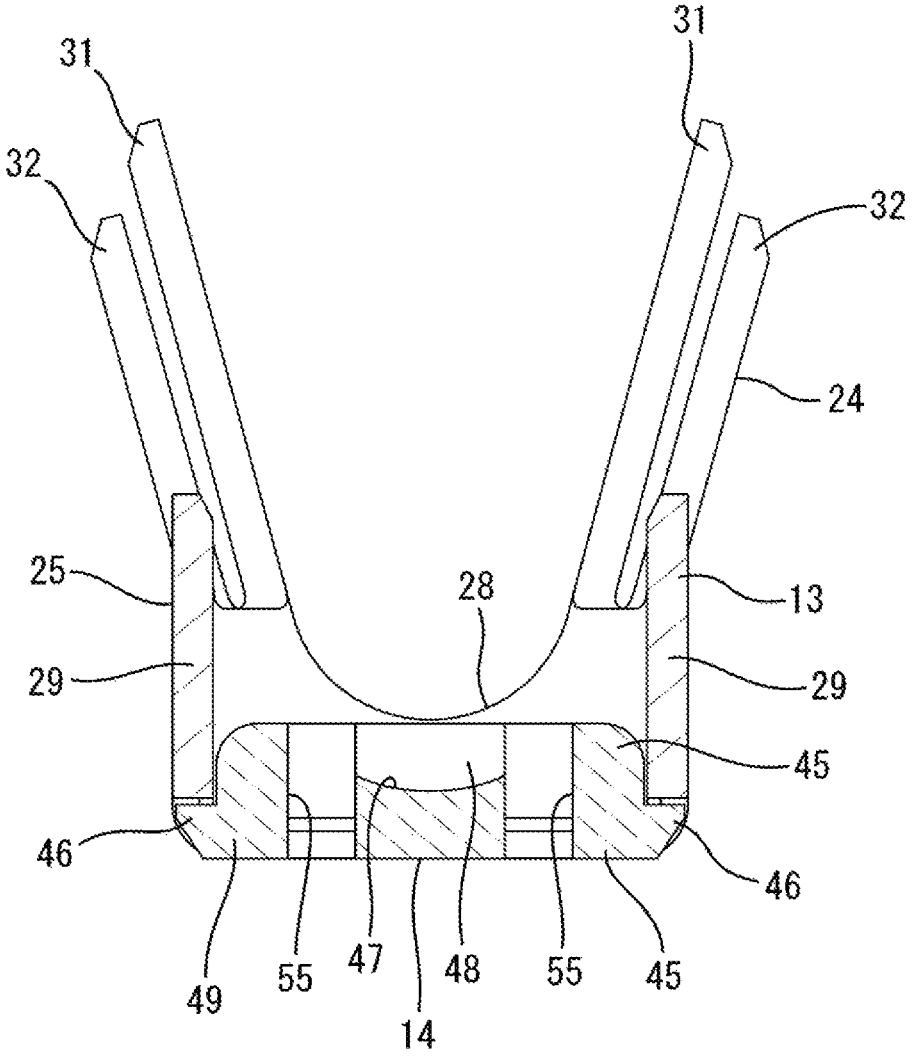
FIG. 7 is a section along B-B of FIG. 6.

An embodiment of the invention is described with reference to FIGS. 1 to 13. A shield terminal 10 of this embodiment is connected to an end part of a shielded cable 90 and includes an inner conductor terminal 11, a dielectric 12, an outer conductor terminal 30 and a short circuit preventing member 14, as shown in FIGS. 2 and 3. Each of the inner conductor terminal 11, the dielectric 12, the outer conductor terminal 13 and the short circuit preventing member 14 is a separate body. The inner conductor terminal 11 is accommodated into the dielectric 12, and each of the dielectric 12 and the short circuit preventing member 14 is assembled with the outer conductor terminal 13 in a separation restricted state. Note that, in the following description, a left side of figures except FIGS. 7 and 11 is defined as a front concerning a front-rear direction and a vertical direction is based on a vertical direction of figures except FIGS. 2 and 5.

<Shielded Cable 90>

The shielded cable 90 is a coaxial cable and includes, as shown in FIG. 3, a core 91 serving as a conductor for transmitting a high-frequency signal, an insulating portion 92 made of resin and covering the outer periphery of the core 91, a shield 93 made of a braided wire and covering the outer periphery of the insulating portion 92 and a sheath 94 made of resin and covering the outer periphery of the shield 93. The sheath 94 is removed over a predetermined range on the end part of the shielded cable 90 to expose the shield 93. Further, the insulating portion 92 is removed to expose the core 91.

<Inner Conductor Terminal 11>

Figure 12:
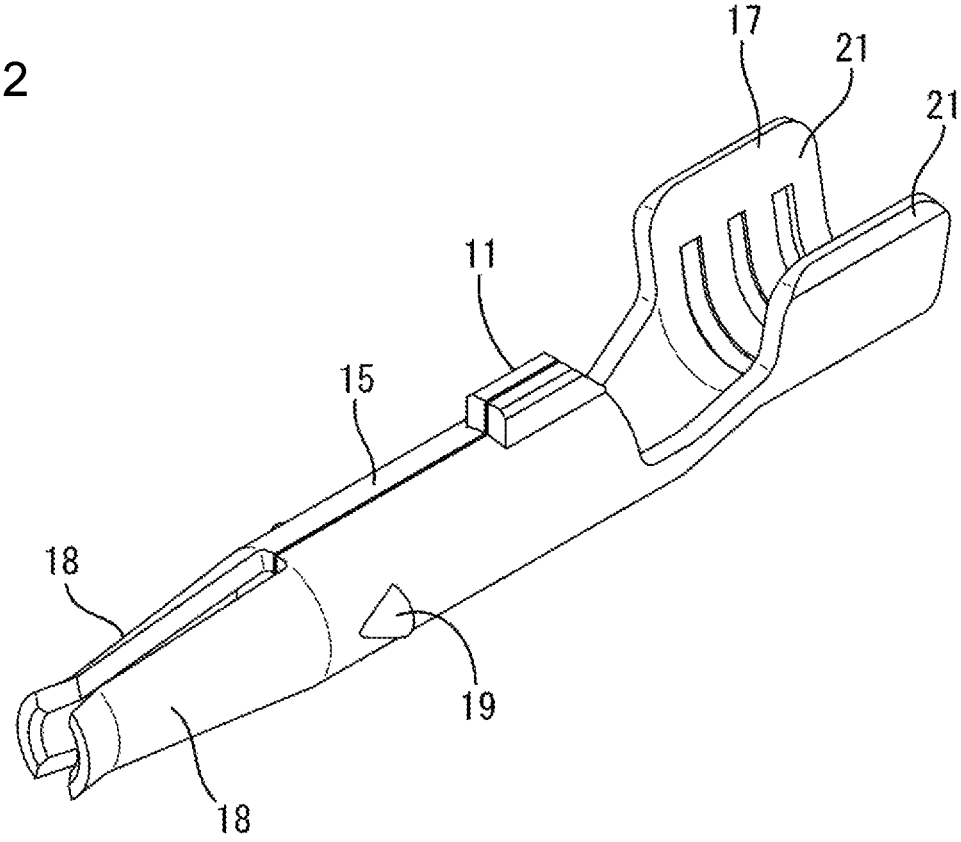
FIG. 12 is a perspective view of the inner conductor terminal viewed obliquely from above.

The inner conductor terminal 11 is formed, such as by bending a conductive metal plate. As shown in FIG. 12, the inner conductor terminal 11 includes a mating connecting portion 15 to be connected to an unillustrated mating inner conductor terminal in a front part and a lead connecting portion 17 to be connected to a later-described inner conductor connecting portion 42 of an electronic element 16 in a rear part. The mating connecting portion 15 includes left and right connecting pieces 18 projecting forward from a hollow cylindrical body. Each connecting piece 18 has an arcuate cross-section and is tapered toward the front. The connecting pieces 18 are connected to a tab of the unillustrated mating inner conductor terminal inserted inside. The hollow cylindrical body of the mating connecting portion 15 has left and right locking projections 19 (only one is shown in FIG. 12) lockable to the dielectric 12.

The lead connecting portion 17 has left and right lead crimping pieces 21 rising from a bottom wall that is continuous with the mating connecting portion 15 to form an open barrel of U-shaped cross-section. As shown in FIG. 2, the lead crimping pieces 21 are wound on the outer periphery of the later-described inner conductor connecting portion 42 of the electronic element 16 in a crimping step.

<Dielectric 12>

Figure 5:
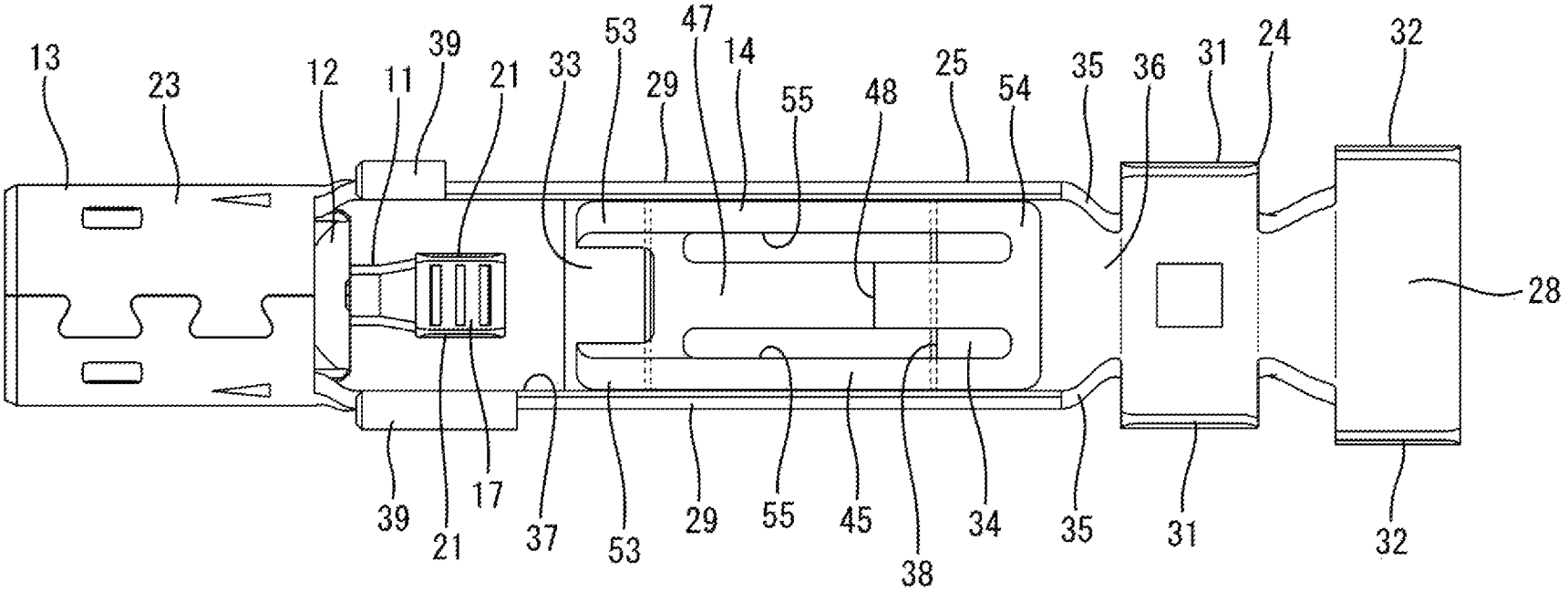
FIG. 5 is a plan view of the outer conductor terminal mounted with the inner conductor terminal, the dielectric and the short circuit preventing member.
Figure 6:
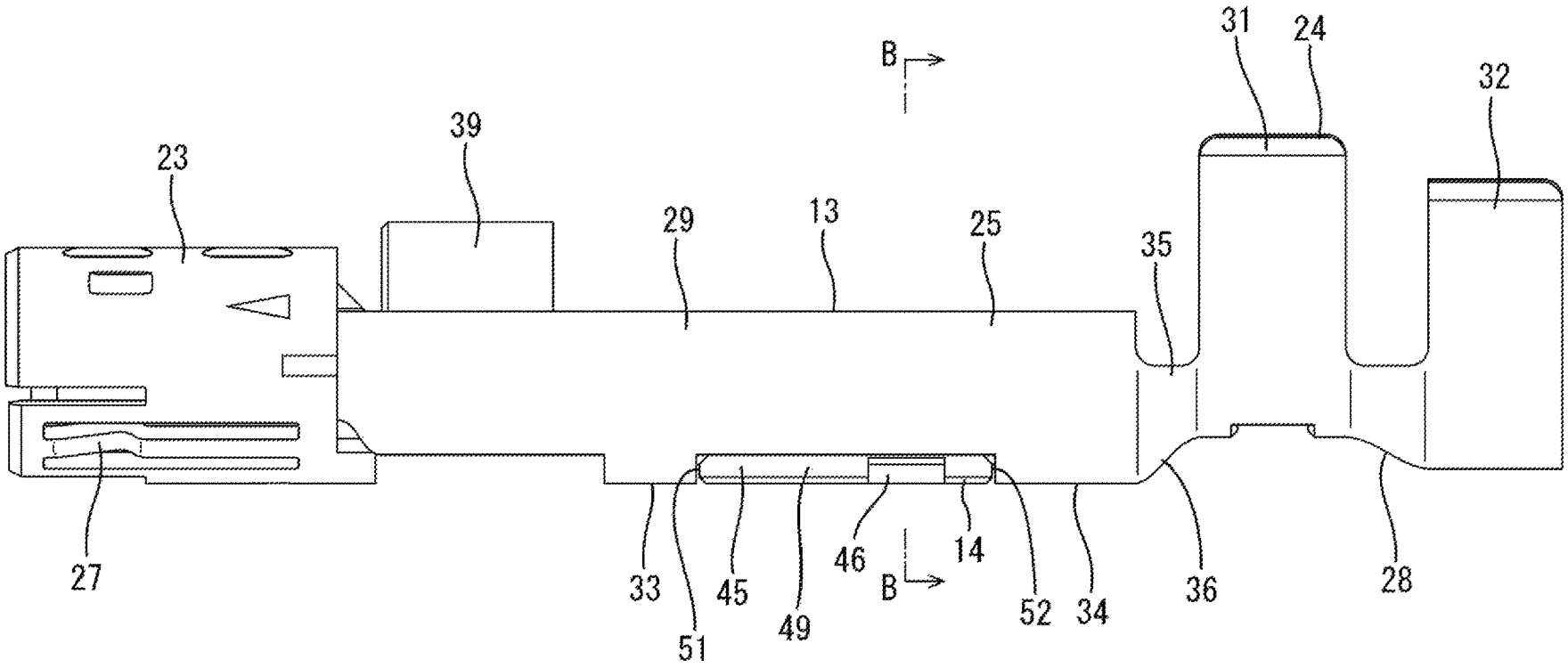
FIG. 6 is a side view of the outer conductor terminal mounted with the inner conductor terminal, the dielectric and the short circuit preventing member.
Figure 13:
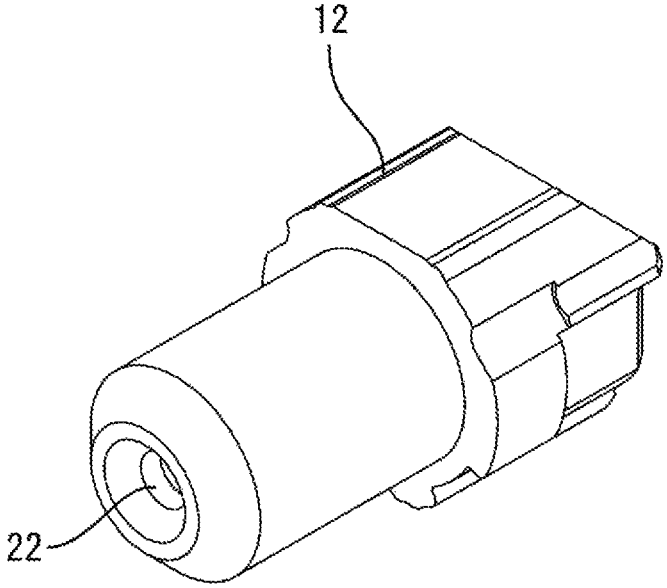
FIG. 13 is a perspective view of the dielectric viewed obliquely from above.

The dielectric 12 is made of synthetic resin in the form of a block, and an accommodating portion 22 penetrates the dielectric 12 in the front-rear direction, as shown in FIGS. 3 and 13. The mating connecting portion 15 of the inner conductor terminal 11 is inserted into the accommodating portion 22 from behind. The inner conductor terminal 11 is retained and held in the accommodating portion 22 by the locking projections 19 locking the inner surface of the accommodating portion 22. As shown in FIGS. 2, 3 and 5, the lead connecting portion 17 is exposed rearwardly of the dielectric 12 with the inner conductor terminal 11 accommodated in the accommodating portion 22.

<Outer Conductor Terminal 13>

Figure 8:
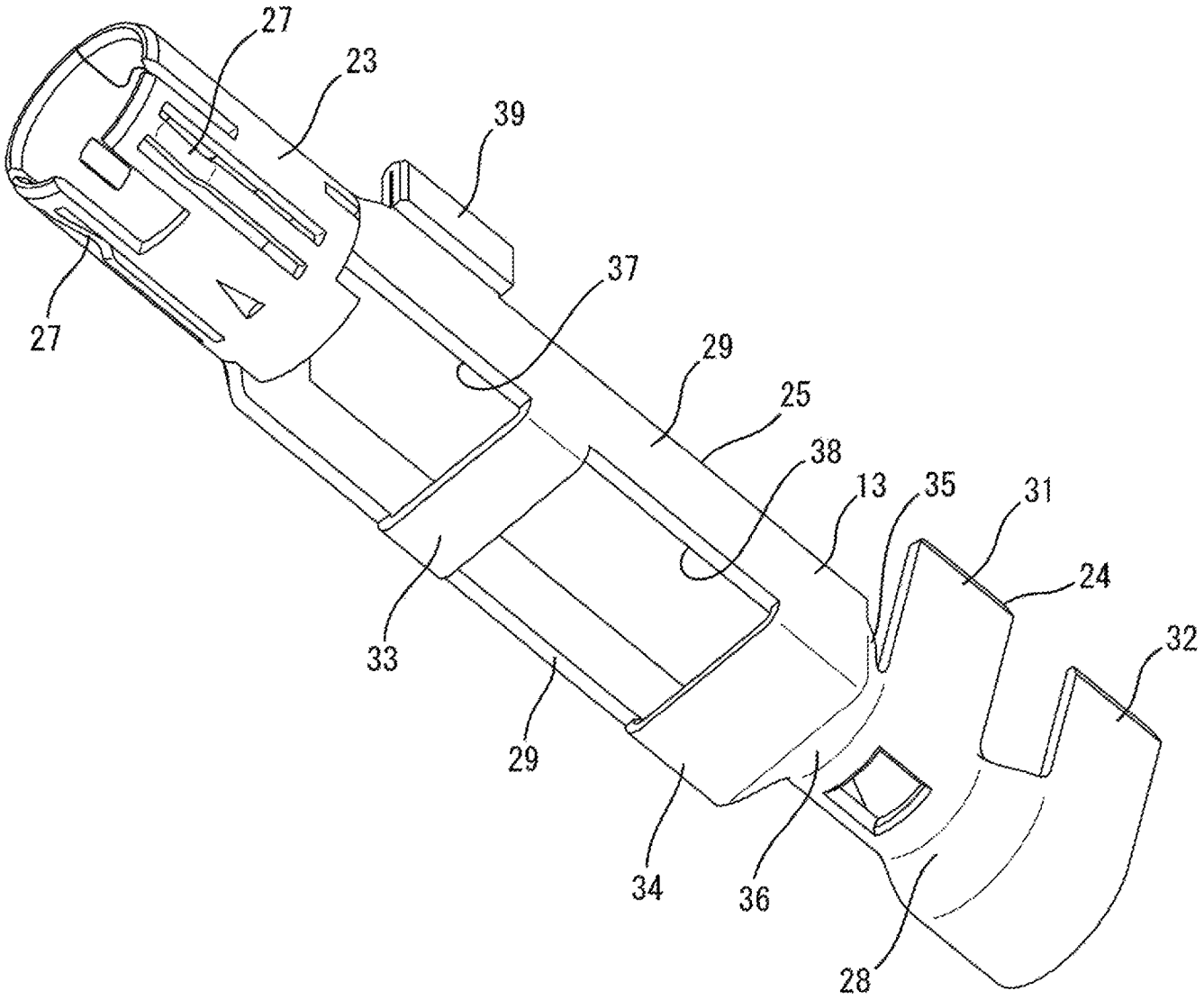
FIG. 8 is a perspective view of the outer conductor terminal viewed obliquely from below.

The outer conductor terminal 13 is formed, such as by bending a conductive metal plate. As shown in FIG. 8, the outer conductor terminal 13 includes a hollow cylindrical fitting 23 in a front part, a barrel 24 in the form of an open barrel in a rear part and a coupling 25 in the form of a bent plate coupling the fitting 23 and the barrel 24 in an intermediate part in the front-rear direction. The coupling 25 is longer than the fitting 23 and the barrel 24 in the front-rear direction.

Figure 4:
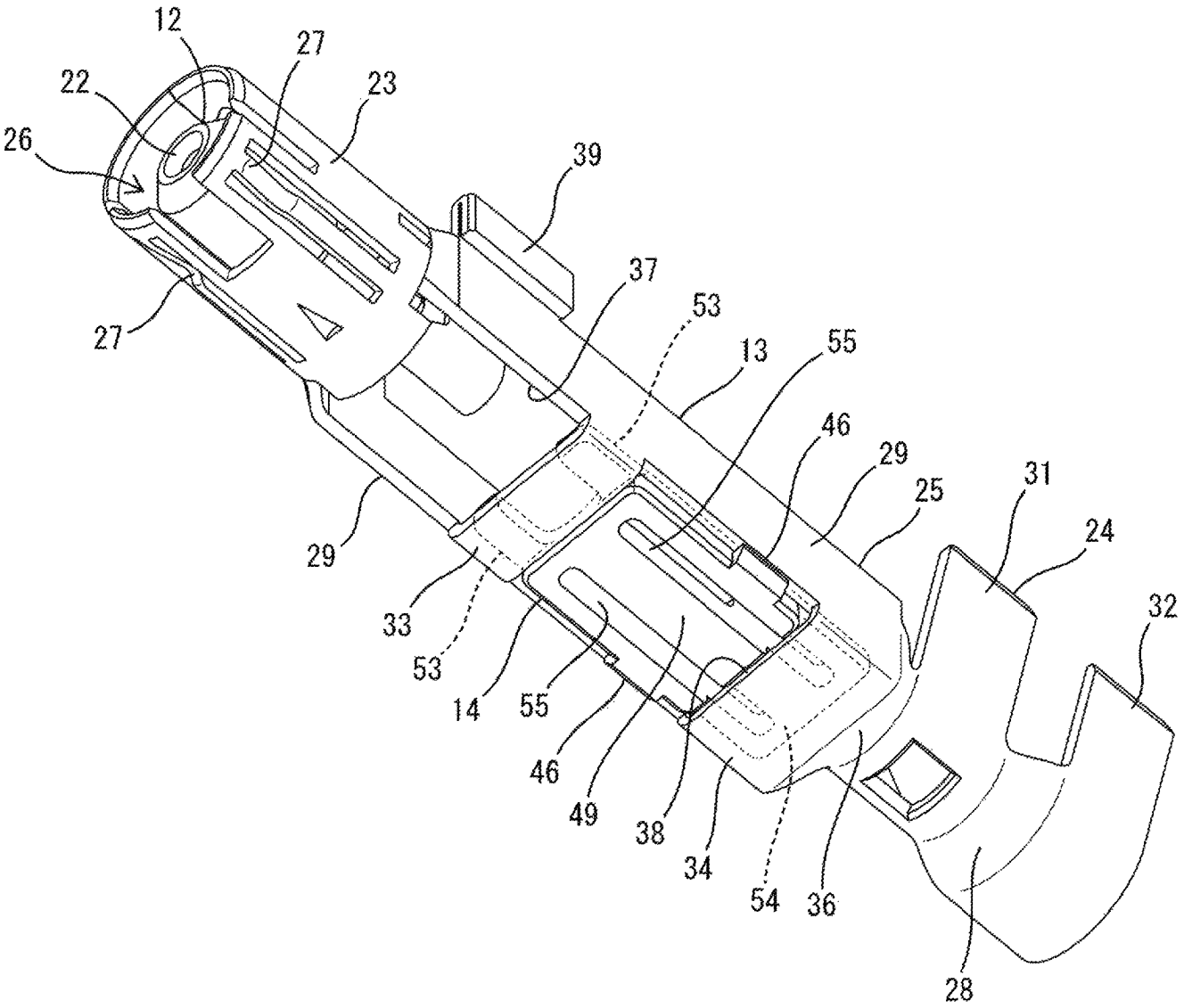
FIG. 4 is a perspective view of an outer conductor terminal mounted with an inner conductor terminal, a dielectric and a short circuit preventing member viewed obliquely from below.

The dielectric 12 is inserted into the fitting portion 23 from behind and is retained in the fitting portion 23. As shown in FIGS. 1, 3 and 4, a forwardly open fitting space 26 is formed between the inner surface of the fitting 23 and a front part of the dielectric 12. An unillustrated mating outer conductor terminal is inserted into the fitting space 26 from the front. The fitting 23 is provided with contacts 27. Each contact 27 contacts the outer surface of the mating outer conductor terminal inserted into the fitting 23. In this way, the outer conductor terminal 13 is connected to the mating outer conductor terminal via the respective contacts 27.

The barrel 24 has a U-shaped cross-section, as shown in FIG. 7, and includes a bottom portion 28 connected to the coupling 25, left and right wire barrel pieces 31 rising from front sides of the bottom portion 28 and left and right insulation barrel pieces 32 rising from a rear side of the bottom portion 28, as shown in FIG. 5. As shown in FIGS. 1 to 3, the wire barrel pieces 31 are wound on the outer periphery of the shield 93 of the shielded cable 90 in the crimping step and the insulation barrel pieces 32 are wound on the outer periphery of the sheath 94 of the shielded cable 90 in the crimping step.

As shown in FIGS. 7 and 8, the coupling 25 includes left and right side portions 29 in the form of flat plates extending along the vertical direction and having a substantially rectangular shape long in the front-rear direction, a bridge 33 in the form of a flat plate bridging between the lower ends of the side portions 29 in an intermediate part in the front-rear direction, and a rear bridge 34 in the form of a flat plate bridging between the lower ends of the side portions 29 in a rear part.

The front ends of the side portions 29 are connected to left and right rear ends of the fitting 23. The rear ends of the side portions 29 are connected to the front ends of the wire barrel pieces 31 via left and right lateral attaching portions 35 whose heights are gradually reduced toward the rear. As shown in FIG. 5, the rear end of the rear bridge 34 is connected to the front end of the bottom portion 28 via a lower attaching portion 36 whose width is gradually reduced toward the rear. Both left and right ends of the lower attaching portion 36 are connected to the both lateral attaching portions 35.

As shown in FIG. 8, a length of the bridge 33 is shorter than that of the rear bridge 34 in the front-rear direction. A substantially rectangular tool insertion hole 37 penetrates through a front part of the bottom wall of the coupling 25 between the bridge 33 and the fitting 23, and a substantially rectangular mounting hole 38 penetrates through a rear part of the bottom wall of the coupling 25 between the bridge 33 and the rear bridge 34. The tool insertion hole 37, the bridge 33, the mounting hole 38 and the rear bridge 34 are arranged successively from the front in the bottom wall of the coupling 25. An unillustrated crimping tool (anvil) for connecting the lead connecting portion 17 of the inner conductor terminal 11 and the later-described inner conductor connecting portion 42 of the electronic element 16 can enter the tool insertion hole 37. As shown in FIGS. 3 and 4, the short circuit preventing member 14 is insertable into the mounting hole 38.

As shown in FIGS. 1 and 2, left and right projections 39 project on front sides of the upper ends of the side portions 29. The projections 39 have a double wall shape by being folded down after projecting up from the upper ends of the side portions 29. Although not described in detail, the projections 39 function to guide the insertion of the shield terminal 10 and restrict the escape of the shield terminal 10 from an unillustrated connector housing when the shield terminal 10 is inserted into the connector housing.

<Electronic Element 16>

The electronic element 16 is for adjusting an electrical characteristic of the shield terminal 10 and, here, configured as a capacitor for adjusting a capacitance. As shown in FIGS. 2 and 3, the electronic element 16 includes a cylindrical body 41, the inner conductor connecting portion 42 in the form of a lead wire extending forward from a center of the front end surface of the body 41 and a core connecting portion 43 in the form of a lead wire extending rearward from a center of the rear end surface of the element body 41. The inner conductor connecting portion 42 is crimped and connected to the lead connecting portion 17 of the inner conductor terminal 11. The core connecting portion 43 is crimped and connected to the core 91 of the shielded cable 90 via a crimping member 44. The crimping member 44 is an open barrel smaller than the barrel 24, and is crimped and connected to the core connecting portion 43 of the electronic element 16 and the core 91 of the shielded cable 90 together.

<Short Circuit Preventing Member 14>

Figure 9:
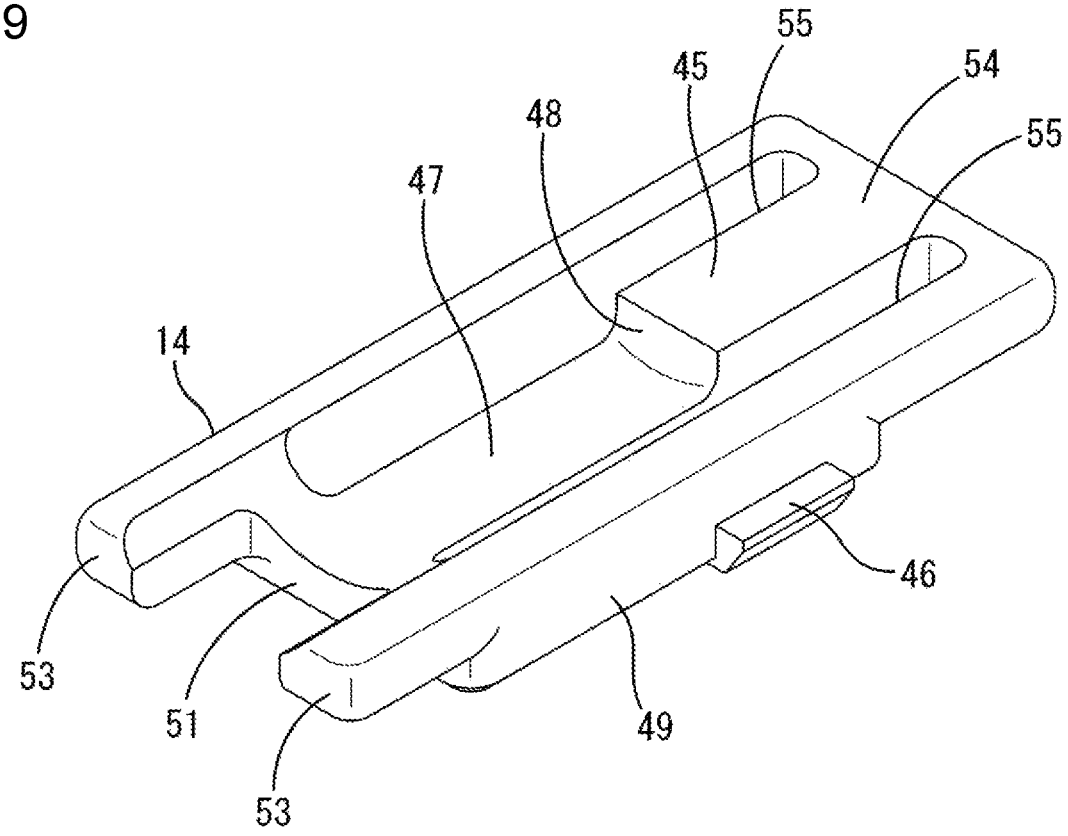
FIG. 9 is a perspective view of the short circuit preventing member viewed obliquely from above.
Figure 10:
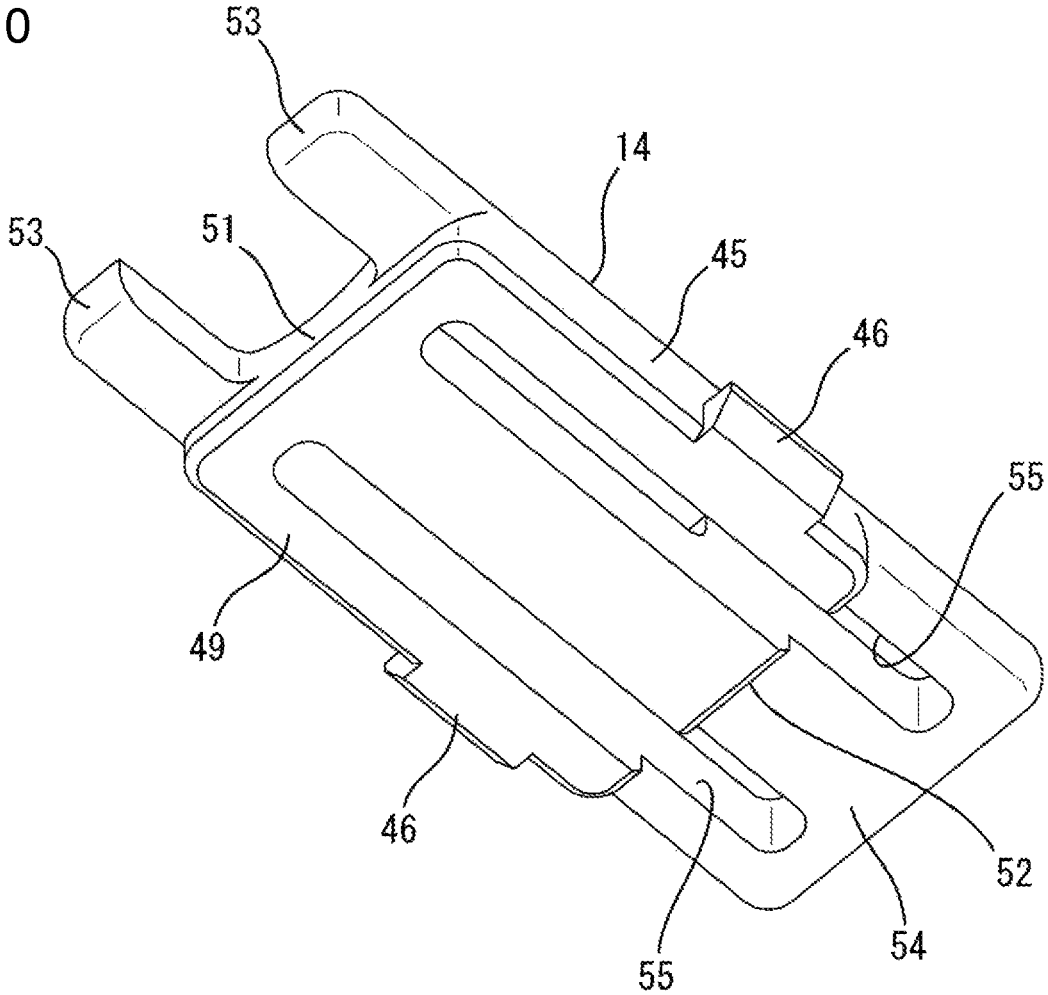
FIG. 10 is a perspective view of the short circuit preventing member viewed obliquely from below.
Figure 11:
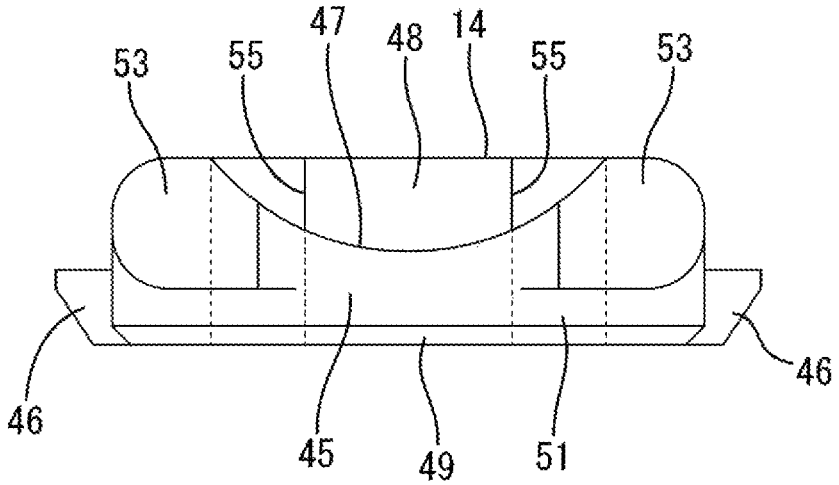
FIG. 11 is a front view of the short circuit preventing member.

The short circuit preventing member 14 is made of synthetic resin and includes, as shown in FIGS. 10 and 11, a supporting 45 in the form of a flat plate and two locking portions 46 projecting toward both left and right sides of the support 45. The short circuit preventing member 14 serves as a pedestal for supporting the electronic element 16. As shown in FIGS. 9 and 11, a supporting surface 47 for placing the electronic element 16 is provided on the upper surface of the support 45. The supporting surface 47 has a curved cross-section along the outer periphery of a lower part of the body 41. The rear end of the supporting surface 47 defines a rear surface 48 arranged along a lateral direction to face forward. A substantially rectangular protrusion 49 projects down on a part of the lower surface of the support 45 aligned with the supporting surface 47, as shown in FIG. 10. As shown in FIG. 4, the protrusion 49 is shaped and sized to fit into the mounting hole 38 of the outer conductor terminal 13. As shown in FIG. 10, the front end of the protrusion 49 serves as a front step 51 along the lateral direction, and the rear end of the protrusion 49 serves as a rear step surface 52 along the lateral direction.

As shown in FIGS. 9 to 11, the supporting 45 includes left and right front projecting pieces 53 projecting forward from the front end. The front projecting pieces 53 have base ends at the same position as the front step 51 of the protrusion 49 in the front-rear direction, thereby forming steps between the front step 51 and the front projecting pieces 53. As shown in FIGS. 3 and 10, a rear end part of the support 45 serves as a rear projecting piece 54 forming a step between the rear step 52 of the protrusion 49 and the rear projecting piece 54.

Left and right end surfaces of the support 45 include left and right end surfaces of the front projecting pieces 53 and the left and right end surfaces of the rear projecting piece 54 and are arranged along the front-rear direction. As shown in FIGS. 9 and 10, the support 45 includes left and right slits 55 in end parts near the left and right end surfaces. The slits 55 are elongated in parallel from the protrusion 49 to the rear projecting piece 54 and define holes penetrating through the supporting portion 45 in a thickness direction.

The locking portions 46 project from rear sides of the both left and right end surfaces of the protrusion 49. The locking portions 46 are ribs of substantially triangular cross-section long in the front-rear direction, and have horizontal upper surfaces along the lateral direction.

<Assembling Method and Structure of Shield Terminal 10>

In assembling, the core connecting portion 43 of the electronic element 16 and the core 91 of the shielded cable 90 are crimped and connected by the crimping member 44 with the core connecting portion 43 and the core 91 facing each other on the same axis.

The protrusion 49 of the short circuit preventing member 14 is inserted into the mounting hole 38 of the outer conductor terminal 13. In the process of inserting the protrusion 49 into the mounting hole 38, the locking portions 46 slide on both left and right edges of the mounting hole 38 and the slits 55 are deformed to narrow a lateral width. When the protrusion 49 is inserted properly into the mounting hole 38, the slits 55 return to have an initial lateral width. Thus, the upper surfaces of the locking portions 46 are locked into contact with the lower ends of the side portions 29 (see FIG. 7), the front projecting pieces 53 are supported on the upper surface of the bridge 33, and the rear projecting piece 54 is supported on the upper surface of the rear bridge 34 (see FIGS. 4 and 5). The front step surface 51 of the protrusion 49 is arranged to face and contact the rear end of the bridge 33, and the rear step 52 of the protrusion 49 is arranged to face and contact the front end of the rear bridge 34 (see FIG. 3). In this way, the short circuit preventing member 14 is held in a separation restricted state in the outer conductor terminal 13.

Subsequently, the electronic element 16 connected to the shielded cable 90, as described above, is placed on the outer conductor terminal 13 holding the short circuit preventing member 14 from above. In this way, the body 41 of the electronic element 16 is placed and supported on the supporting surface 47 of the short circuit preventing member 14, the inner conductor connecting portion 42 of the electronic element 16 is arranged between the lead crimping pieces 21 of the lead connecting portion 17 of the inner conductor terminal 11, the shield 93 exposed on the end part of the shielded cable 90 is arranged between the wire barrel pieces 31 and the sheath 94 on the end part of the shielded cable 90 is arranged between the insulation barrel pieces 32.

Further, the crimping member 44 crimped to both the core connecting portion 43 of the electronic element 16 and the core 91 of the shielded cable 90 is arranged on the rear projecting piece 54 of the short circuit preventing member 14 and between the slits 55 (see FIGS. 2 and 3). The core connecting portion 43 exposed between the rear end surface of the element body portion 41 and the crimping member 44, and the core 91 exposed between the insulating portion 92 of the shielded cable 90 and the crimping member 44, also mostly are arranged on the rear projecting piece 54 of the support 45. The electronic element 16 is positioned on the supporting surface 47 of the support 45 with both leftward and rightward movements thereof restricted by both left and right parts of the supporting surface 47 of the support 45.

Subsequently, unillustrated crimping tools composed of a crimper and an anvil are brought into contact with the lead connecting portion 17 and the barrel 24 to perform a crimping operation. For example, the lead connecting portion 17 is crimped by bringing the crimper and the anvil closer with the crimper arranged above the lead connecting portion 17 and the anvil arranged below the lead connecting portion 17 to deform and wind the lead crimping pieces 21 on the outer periphery of the inner conductor connecting portion 42. In this way, the lead connecting portion 17 is crimped and connected to the inner conductor connecting portion 42. In this case, the anvil can be brought into contact with a lower surface of the lead connecting portion 17 through the tool insertion hole 37 of the outer conductor terminal 13. Further, the crimper approaches the short circuit preventing member 14 in the process of pressing and deforming the lead crimping pieces 21, but can avoid interference with the short circuit preventing member 14 by entering between the front projecting pieces 53.

Similarly, corresponding crimping tools are brought into contact with the barrel 24 to crimp and connect the wire barrel pieces 31 to the shield 93 of the shielded cable 90 and to crimp and connect the insulation barrel pieces 32 to the sheath 94 of the shielded cable 90. The lead connecting portion 17, the wire barrel pieces 31 and the insulation barrel pieces 32 can be crimped in the same step. Thereafter, an unillustrated cover member for covering an opening part of the coupling 25 is mounted on the shield terminal 10. The cover is connected to the outer conductor terminal 13 and has a shielding function.

The electronic element 16 built in the shield terminal 10 is supported with both left and right sides thereof covered by the side portions 29 and a lower side thereof covered by the short circuit preventing member 14. A connecting part of the inner conductor connecting portion 42 and the lead connecting portion 17 is arranged at a position corresponding to the tool insertion hole 37 of the outer conductor terminal 13 and hardly contacts a bottom surface part of the outer conductor terminal 13.

On the other hand, the crimping member 44, which is a connecting part of the core connecting portion 43 and the core 91, is proximate to the rear bridge 34, which is the bottom surface part of the outer conductor terminal 13. However, the rear projecting piece 54 of the short circuit preventing member 14 is interposed between the crimping member 44 and the rear bridge 34, and the crimping member 44 is covered from below by the rear projecting piece 54. Thus, the crimping member 44 cannot contact and short to the outer conductor terminal 13 and reliability in transmitting a high-frequency signal can be ensured. Further, the short circuit preventing member 14 serves as a mark in positioning the electronic element 16. Furthermore, an impedance control can be performed by the short circuit preventing member 14.

Further, since the short circuit preventing member 14 has a function of supporting the electronic element 16 in addition to a function of preventing a short circuit of the electronic element 16 to the outer conductor terminal 13, the configuration of the shield terminal 10 can be simplified as compared to the case where the short circuit preventing function and the supporting function are respectively realized by separate members.

Furthermore, since the short circuit preventing member 14 is arranged away from the dielectric 12, the dielectric 12 need not extend long rearward and the dielectric 12 can be small. Particularly, by providing the short circuit preventing member 14 separately from the dielectric 12, the tool insertion hole 37 can be provided in the outer conductor terminal 13 without any trouble and the inner conductor connecting portion 42 and the lead connecting portion 17 can be connected after the inner conductor terminal 11 is incorporated into the outer conductor terminal 13 together with the dielectric 12 so that a degree of freedom in design and process can be enhanced.

Other embodiments are briefly described below.

The electronic element may be a resistor with lead wires or a diode with lead wires without being limited to the capacitor.

The connection of the core connecting portion of the electronic element to the core of the shielded cable, and the connection of the inner conductor connecting portion of the electronic element to the lead connecting portion of the inner conductor terminal are not limited to connection by welding and may be connection by soldering, resistance welding or ultrasonic welding.

The short circuit preventing member may be provided separately from a part for supporting the electronic element.

LIST OF REFERENCE SIGNS

10 . . . shield terminal
11 . . . inner conductor terminal
12 . . . dielectric
13 . . . outer conductor terminal
14 . . . short circuit preventing member
16 . . . electronic element
47 . . . tool insertion hole
42 . . . inner conductor connecting portion
43 . . . core connecting portion
44 . . . crimping member
45 . . . support
90 . . . shielded cable
91 . . . core
93 . . . shield

What is claimed is:

1. A shield terminal, comprising:

an inner conductor terminal;

an outer conductor terminal surrounding the inner conductor terminal, the outer conductor terminal being connected to a shield of a shielded cable;

a dielectric arranged between the inner conductor terminal and the outer conductor terminal;

an electronic element including a body and a core connecting portion extending rearward from the body and to be connected to a core of the shielded cable and an inner conductor connecting portion extending forward from the body to be connected to the inner conductor terminal; and an insulating short circuit preventing member having a supporting portion to be locked to the outer conductor terminal, a supporting surface formed on the supporting portion on which the body of the electronic element is supported, and a rear projecting piece projecting from the supporting portion and arranged between the core connecting portion and the outer conductor terminal.

2. The shield terminal of claim 1, wherein the short circuit preventing member is separate from the dielectric and is arranged away from the dielectric.

3. The shield terminal of claim 2, wherein the outer conductor terminal is provided with a tool insertion hole open between the short circuit preventing member and the dielectric, and the inner conductor connecting portion is arranged to face the tool insertion hole.

4. The shield terminal of claim 1, further comprising a crimping member crimping the core connecting portion to the core of the shielded cable.

5. The shield terminal of claim 4, wherein the rear projecting piece of the short circuit preventing portion is arranged between the crimping member and the outer conductor terminal.

* * * * *